US006348109B1

(12) United States Patent
Sandberg

(10) Patent No.: US 6,348,109 B1
(45) Date of Patent: Feb. 19, 2002

(54) STEEL MATERIAL AND METHOD FOR ITS MANUFACTURING

(75) Inventor: Odd Sandberg, Uddeholm (SE)

(73) Assignee: Uddeholm Tooling Aktiebolag, Hagfors (SE)

( * ) Notice: Subject to any disclaimer, the term of this patent is extended or adjusted under 35 U.S.C. 154(b) by 0 days.

(21) Appl. No.: 09/646,573

(22) PCT Filed: Mar. 2, 1999

(86) PCT No.: PCT/SE99/00295

§ 371 Date: Sep. 19, 2000

§ 102(e) Date: Sep. 19, 2000

(87) PCT Pub. No.: WO99/49093

PCT Pub. Date: Sep. 30, 1999

(30) Foreign Application Priority Data

Mar. 23, 1998 (SE) ..... 9800954

(51) Int. Cl.[7] ..... C22C 38/24; C22C 38/22; C22C 38/36

(52) U.S. Cl. ..... 148/324; 148/545; 420/10; 420/12; 420/15

(58) Field of Search ..... 420/10, 12, 15, 420/27; 148/545, 324

(56) References Cited

U.S. PATENT DOCUMENTS 4,721,153 A * 1/1988 Sano et al. ..... 164/448
5,225,007 A * 7/1993 Hattori et al. ..... 148/541
5,316,596 A * 5/1994 Kataoka ..... 148/321

FOREIGN PATENT DOCUMENTS

| | | | | |
|---|---|---|---|---|
| CA | 1339766 | | 3/1998 | ..... C22C/38/24 |
| JP | 59-064748 A | * | 4/1984 | |
| JP | 64-31951 | | 2/1989 | ..... C22C/38/24 |
| JP | 09-256108 A | * | 9/1997 | |

* cited by examiner

*Primary Examiner*—George Wyszomierski
*Assistant Examiner*—Janelle Combs-Morillo
(74) *Attorney, Agent, or Firm*—Michael D. Bednarek; Shaw Pittman LLP

(57) ABSTRACT

A steel material which is manufactured in a non-powder metallurgical way, comprising production of ingots or castings from a melt, consists of an alloy having the following chemical composition in weight-% Carbon: 2.0–4.3%, Silicon: 0.1–2.0%, Manganese: 0.1–2.0%, Chromium: 5.6–8.5%, Nickel: max. 1.0%, Molybdenum: 1.7–3%, wherein Mo completely or partly can be replaced by double the amount of W, Niobium: max. 2.0%, Vanadium: 6.5–15%, wherein V partly can be replaced by double amount of Nb up to max. 2% Nb, Nitrogen: max. 0.3%, wherein the contents of on the one hand carbon and nitrogen and on the other hand vanadium and any possibly existing niobium shall be balanced relative to each other, such that the contents of the said elements shall lie within the area of A, B", E, F, B', B, C, D, A in the co-ordinate system in FIG. 2, where V+2Nb, C+N co-ordinates for said points are A: (9,3.1), B": (9,2.85), E: (15,4.3), F: (15,3.75), B': (9,2.65), B: (9,2.5), C: (6.5,2.0), D: (6.5,2.45).

31 Claims, 7 Drawing Sheets

STEEL MATERIAL AND METHOD FOR ITS MANUFACTURING

TECHNICAL FIELD

The invention relates to a new steel material which is manufactured in a non-powder metallurgical way, comprising manufacturing of ingots or castings from a melt. The steel material consists of an alloy, which besides iron and carbon, contains chromium, vanadium, and molybdenum as its substantial alloying elements in amounts which are chosen and balanced in such a way that the steel after hardening and tempering has a hardness and a microstructure which makes the material suitable in the first place for cold work tools but also for other applications where high requirements are raised on wear resistance and comparatively good toughness, such as materials for shaping or working ceramic masses, e.g. for tools to be used in the brick-making industry. The invention also relates to the use of the steel material and to a method for the manufacturing of the material, including the method for the heat treatment of the material.

BACKGROUND OF THE INVENTION

In the first place tool steels containing more than 10% chromium, which are manufactured conventionally, are used as materials for cold work tools, on which very high requirements are raised as far as hardness and wear resistance are concerned. The standardised steels AISI D2, D6, and D7, which today are used for abrasive cold work applications, are typical examples of this type of steels. The nominal compositions of these known steels are stated in Table 1.

TABLE 1

Conventional cold work steels - nominal compositions, weight-%

| | C | Si | Mn | Cr | Mo | W | V |
|---|---|---|---|---|---|---|---|
| AISI D2 | 1.5 | 0.3 | 0.3 | 12.0 | 1.0 | — | 1.0 |
| AISI D6 | 2.1 | 0.3 | 0.8 | 12.5 | — | 1.3 | — |
| AISI D7 | 2.35 | 0.3 | 0.5 | 12.0 | 1.0 | — | 4.0 |

Like all ledeburitic steels, steels of the above mentioned type solidify through the precipitation of austenite, whereafter $M_7C_3$-carbides are formed in the regions of residual liquid phase. This gives a material which does not satisfy high requirements on some product features which are of significant importance for cold work steels, namely good abrasive wear resistance in combination with good toughness. It is also a drawback with these conventional ledeburitic tool steels that they have a rather bad hot-workability.

As materials for cold work steels there are also used tool steels with high contents of vanadium, which are manufactured powder metallurgically. Those steels which are known by their trade names Vanadis®4 and Vanadis®10 are examples of this type of steels. The nominal compositions of these steels are stated in Table 2.

TABLE 2

Powder metallurgically manufactured cold work steels - nominal compositions, weight-%, balance Fe and impurities

| | C | Si | Mn | Cr | Mo | V |
|---|---|---|---|---|---|---|
| Vanadis ® 4 | 1.5 | 1.0 | 0.4 | 8.0 | 1.5 | 4.0 |
| Vanadis ® 10 | 2.9 | 1.0 | 0.5 | 8.0 | 1.5 | 9.8 |

The above, powder metallurgically manufactured steels offer extremely good combinations of wear resistance and toughness but are expensive to manufacture.

DISCLOSURE OF THE INVENTION

It is a purpose of the invention to provide a new steel material of steel alloy which can be manufactured in a conventional way through the manufacturing of a melt, from which there are cast ingots, which can be hot-worked to the shape of bars, plates, etc, of which there can be manufactured tools or other articles, which can be heat treated for the achievement of a final product having the desired combination of features. The conventional ingot manufacturing can be completed through some subsequent melt-metallurgical process-step, such as e.g. electro-slag-refining (ESR) or, as an alternative process, the building up of ingots of molten metal drops which are caused to solidify, such as according to the process which is known by the name of Osprey.

The field of use of the material of the invention may include anything from wear parts, e.g. within mining industry, to tools within the field of conventional cold work for the manufacturing of tools for blanking and forming, cold extrusion tooling, powder pressing, deep drawing etc, and tools or machine components for forming or working of ceramic masses, e.g. in the brick making industry. In connection herewith it is a particular objective of the invention to provide a material which has a better combination of wear resistance and toughness than conventional ledaburitic cold work steels of type AISI D2, D6, or D7.

Further it is an object of the invention to provide a material of an alloy which has a better hot workability than the said conventional ledaburitic cold work steels, wherein the yield in production in forging shops and rolling mills can be improved and hence also the production economy.

It is also a purpose of the invention to provide a material having good heat treatment properties. Thus it shall be possible to hardened the steel from austenitising temperatures below 1200° C., preferably from temperatures between 900 and 1150° C., typically from 950 to 1100° C. and the steel shall have a good hardenability; a good dimensional stability on heat treatments; and attain a hardness of 55–66 HRC, preferably 60–66 HRC, through secondary hardening.

An acceptable cutability and an acceptable grindability are other desirable features.

These and other aims can be achieved therein that the invention is characterised by what is stated in the appending, independent patent claims.

FIG. 1 illustrates a typical constitutional diagram of an alloy having vanadium, carbon, and molybdenum contents according to the invention and varying chromium contents. The diagram shows the phases in a state of equilibrium at different temperatures. When an ingot or a casting is caused to solidify slowly, the alloy will solidify through a primary precipitation of hard particles of MX-type in molten phase, where M is V and/or Nb, but preferably V, and X is C and/or N, but preferably C. The remaining, residual melt has a comparatively low content of alloying elements and will solidify to form austenite and MX (γ+MX region in the phase diagram). During continued cooling, the γ+MX+$M_7C_3$-region is passed rather quickly, in which region a smaller amount of carbides of $M_7C_3$-type can be precipitated, where M substantially is chromium.

Thus it is typical for the material of the invention that its micro-structure at the temperature 1100° C. in the state of equilibrium consists of austenite in molten phase, and hard particles of MX-type precipitated in the liquid phase, said M being V and/or Nb, but preferably V, and X is C and N, and also, possibly, a smaller amount of secondarily precipitated hard particles, normally max 2%, preferably max 1 vol-%, in the first place $M_7C_3$-carbides, in which M substantially is Cr.

The solidified structure of conventional ledaburitic cold work steel, which typically is lamellar, thus is replaced by an even distribution of hard components of MX-type, more than 50 vol-% of which having sizes within the range 3–20 μm and, typically a more or less round or elongated, rounded shape and possibly with a smaller amount of lamellar, solidified structure consisting of $M_7C_3$-carbides. After hot-working there is achieved a pronouncedly homogenous and finely dispersed carbide distribution, which is believed to be the main reason why the steel achieves a better hot workability than conventional ledaburitic cold work steels which are manufactured in a non-powder metallurgical way.

In connection with heat treatment comprising hardening and tempering, the material is heated to the γ+MX-region of the phase diagram, wherein any existing $M_7C_3$-carbides, are dissolved and there is again achieved a structure consisting of austenite and hard particles of MX-type distributed in the austenite. At rapid cooling to ambient temperature, the austenite is transformed to martensite. The γ+M+$M_7C_3$-region is passed comparatively quickly, which suppresses the formation of $M_7C_3$-carbides. Therefor it is also typical for the steel material of the invention that it at room temperature has a microstructure consisting of a matrix which substantially consists of martensite and in this matrix 10–40 vol-% and at some preferred embodiments of the invention, e.g. steels for cold work tools, more particularly 10–25 vol-%, and at some other preferred embodiments of the invention, such as for tools or machine components for the working of ceramic masses, e.g. within the brick-making industry, most conveniently 20–40 vol-% of said primary hard particles of MX-type which are precipitated in liquid phase, said hard particles typically having a rounded shape. Further, there may exist secondarily precipitated hard particles of sub-microscopic size. Because of the small size of the secondarily precipitated particles, it is difficult to determine their chemical composition and also the amount of them without access of very advanced equipment. However, it can be presupposed that such products exist to some extent and then substantially in the form of MC-carbides and $M_7C_3$-carbides, in which M is substantially vanadium and chromium, respectively. After hardening and tempering, the material of the invention has a hardness between 55 and 66 HRC, the said microstructure and hardness being obtainable by heating the material to a temperature between 900 and 1150° C., through-heating the material at said temperature for a period of time of 15 min–2 h, cooling the material to room temperature and tempering it one or several times at a temperature of 150–650° C.

As far as the individual alloy elements and their interaction are concerned, the following apply.

Vanadium, carbon, and nitrogen shall exist in a sufficient amount in order that the material shall be able to contain 10–40 vol-%, and at some preferred embodiments of the invention, e.g. steels for hot worked tools, more particularly 10–25 vol-%, and at some other preferred embodiments of the invention, such as for tools or machine components for working ceramic masses, e.g. in the brick manufacturing industry, more particularly 20–40 vol-% hard particles of MX-type, and the matrix also contain 0.6–0.8% carbon in solid solution, wherein the fact that some carbon and nitrogen can be bound in the form of said, secondarily precipitated hard particles, in the first place $M_7C_3$-carbides, also shall be considered. It shall be mentioned that nitrogen normally does not contribute to any substantial degree to the formation of said primary or secondary precipitations, since nitrogen shall not exist in the steel above impurity level or as an accessory element from the manufacture of the steel, i.e. max 0.3%, normally max 0.1%.

Vanadium can partly be replaced by niobium up to max 2% niobium, but this opportunity is preferably not utilised. Typically, the said hard particles to the great part consist of MC-carbides, more particularly substantially $V_4C_3$-carbides. The said hard particles are comparatively large and it is estimated that at least 50 vol-% of the hard particles exist as finally dispersed, discrete particles in the matrix, having sizes between 3 and 20 μm. Typically, they have a more or less rounded shape. These conditions contribute to the provision of a good hot-workability of the steel. Furthermore, because of the high hardness of the hard particles of said MX-type, and because of the sizes of the particles, they also to a great degree contribute to the provision of a desired abrasive wear resistance of the material.

The vanadium content shall be at least 6.5% and max 15% and preferably max 13%. According to one aspect of the invention, the vanadium content is max 11%. According to another aspect of the invention, the vanadium content preferably shall be at least 7.5% at the same time as the maximum vanadium content amounts to 9%. According to still another aspect of the invention, the preferably chosen vanadium content, however, shall lie between 6.5 and 7.5%. When it is here referred to vanadium it shall be recognised that vanadium completely or partly can be replaced by twice the amount of niobium up to max 2% niobium.

The carbon content shall be adapted to the content of vanadium and any existing niobium in order that there shall be obtained 10–40 vol-%, and according to some, above mentioned aspects of the invention, more particularly 10–25 vol-% or 20–40 vol-% of said primarily precipitated hard particles of MX-type, and also 0.6–0.8, preferably 0.64–0.675% carbon in the tempered martensite, wherein also the fact shall be considered that secondary precipitation of in the first place MC-carbides and $M_7C_3$-carbides can occur to some extent, said secondary precipitation also consuming some carbon. The conditions that apply for the relations between vanadium and niobium on one side and carbon on the other side are visualised in FIG. 2, which shows the carbon content versus the content of V+2 Nb. In the co-ordinate system in FIG. 2, where the content of V+2 Nb is abscissa, and the carbon content forms the axes of ordinates, the corner-points of the drawn figures have the co-ordinates stated in Table 3.

TABLE 3

| | V + 2 Nb | C + N |
|---|---|---|
| A | 9 | 3.1 |
| B | 9 | 2.5 |
| B' | 9 | 2.65 |
| B" | 9 | 2.85 |
| C | 6.5 | 2.0 |
| C' | 6.5 | 2.1 |
| C" | 6.5 | 2.25 |
| C'" | 7.5 | 2.5 |
| D | 6.5 | 2.45 |
| D' | 7.5 | 2.7 |
| E | 15 | 4.3 |
| E' | 13 | 3.83 |
| E" | 11 | 3.35 |
| F | 15 | 3.75 |
| F' | 13 | 3.4 |
| F" | 11 | 3.05 |

According to a first aspect of the invention, the contents of vanadium, niobium, carbon+nitrogen shall be adapted to each other such that the said co-ordinates will lie within the range of the area defined by the comer-points A, B", E, F, B', B, C, D, A.

According to a second aspect of the invention, the contents of vanadium, niobium, carbon+nitrogen shall be adapted to each other such that the said co-ordinates will lie within the range of the area defined by the comer-points A, B, C, D, A.

According to a third aspect of the invention, the contents of vanadium, niobium, carbon+nitrogen shall be adapted to each other such that the said co-ordinates will lie within the range of the area defined by the corner-points A, B', C', D, A in the co-ordinate system in FIG. 2.

According to a fourth aspect of the invention, the co-ordinates shall lie within the range of the area defined by the corner-points A, B", C", D, A.

According to a fifth aspect of the invention, the co-ordinates shall lie within the range of the area defined by the corner-points A, B", C'", D', A.

According to a preferred embodiment, the co-ordinates preferably may lie within the range of the area defined by the corner-points A, B', C', C", C'", D', A.

According to another preferred embodiment, the co-ordinates preferably may lie within the range of the area defined by the corner-points B", B', C', C", B".

According to a still another preferred embodiment, the co-ordinates lie within the range of the area defined by the comer-points D', C'", C", D, D'.

The above mentioned second through fifth aspects, and said preferred embodiments, particularly concern the use of the steel for cold work tools. According to a sixth aspect of the invention, which particularly concerns the use of the steel for tools or machine parts for working ceramic masses, e.g. within the brick industry, the contents of vanadium, niobium and carbon+nitrogen may be adapted to each other such that the co-ordinates of said points will lie within the range of the area defined by the corner-points E, F, B', B", E in the co-ordinate system in FIG. 2.

According to a seventh aspect of the invention, the co-ordinates more particularly may lie within the range of the area defined by the corner-points E, F, F', E', E.

According to an eighth aspect of the invention, the co-ordinates should lie within the range of the area defined by the comer-points E', F', F", E", E', and according to still another aspect within the range of the area defined by the comer-points E", F", B', B", E".

Chromium shall exist in a amount of at least 5.6%, preferably at least 6%, suitably at least 6.5%, in order that the steel shall get a good hardenability, i.e. an ability to be through-hardened also in case of thick steel objects. The upper limit of possible content of chromium is determined by the risk of formation of non-desired $M_7C_3$ carbides because of segregation during the solidification of the melt. The chromium content therefore must not exceed 8.5% and should preferably be less than 8%, suitably max 7.5%. An amount of 7% is a typical chromium content, which is comparatively low in view of the desired hardenability.

In order that the material nevertheless shall get desired hardenabilty, without risk of serious segregation, the steel alloy also shall contain at least 1.7% molybdenum, preferably 1.7–3% molybenum, suitably 2.1–2.8 molybdenum. Typically, the steel contains 2.3% molybdenum. Molybdenum in principle completely or partly may be replaced by the double amount of tungsten. Preferably, however, the steel does not contain tungsten more than at impurity level.

Silicon and manganese may exist in amounts which are normal for tool steels. Each of them therefore exists in the steel in amounts between 0.1 and 2%, preferably in amounts between 0.2 and 1.0%. The balance is iron and impurities and accessory elements in normal amounts, wherein the term accessory elements means harmless elements which normally are added in connection with the manufacture of the steel and which may exist as residual elements.

The following is a conceivable, preferred composition of the steel according to the invention: 2.55 C, 0.5–1.0 Si, 0.5–1.0 Mn, 7.0 Cr, 8.0 V, 2.3 Mo, balance iron and unavoidable impurities and accessory elements.

Another conceivable, preferred composition is: 2.7 C, 0.5–1.0 Si, 0.5–1.0 Mn, 7.0 Cr, 8.0 V, 2.3 Mo, balance iron and unavoidable impurities and accessory elements.

Still another conceivable, preferred composition is: 2.45 C, 0.5–1.0 Si, 0.5–1.0 Mn, 7.5 Cr, 8.0 V, 2.3 Mo, balance iron and unavoidable impurities and accessory elements.

The above mentioned conceivable, preferred compositions of the steel of the invention are particularly suited for cold work steels. A conceive, preferred composition for the use of the steel for tools and machine parts for working cheramic masses is: 3.5 C, 0.5–1.0 Si, 0.5–1.0 Mn, 7.0 Cr, 12.0 V, 2.3 Mo, balance iron and unavoidable impurities and accessory elements.

Another conceivable, preferred composition for said use is: 3.9 C, 0.5–1.0 Si, 0.5–1.0 Mn, 7.0 Cr, 14.0 V, 2.3 Mo, balance iron and unavoidable impurities and accessory elements.

Still another conceivable, preferred composition for said use is: 3.0 C, 0.5–1.0 Si, 0.5–1.0 Mn, 7.0 Cr, 10.0 V, 2.3 Mo, balance iron and unavoidable impurities and accessory elements.

At the manufacture of the steel material of the invention there is first produced a melt having the characteristic, chemical composition of the invention. This melt is cast to ingots or castings, wherein the melt is caused to solidify so slowly that there is precipitated in the melt during the solidification process 10–40 vol.-%, preferably, depending on the intended use of the steel, 10–25 vol.-% or 20–40 vol.-% of hard particles of MX type, where M is vanadium and/or niobium, preferably vanadium, and X is carbon and nitrogen, preferably essentially carbon, at least 50 vol.-% of said hard particles having sizes between 3 and 20 $\mu$m, and that the material, in connection with the heat treatment of the steel material, possibly after hot working and/or machining to desired product shape, is heated to a temperature within the temperature range of 900–1150° C., where the microstructure of the steel alloy at equilibrium consists of austenite and hard particles of said MX type, that the material is maintained at this temperature for a period of time of 15 min–2 h, from which temperature the material is cooled to room temperature, wherein the austenitic matrix of the steel is transferred to martensite containing said primarily precipitated hard particles and carbon in solid solution, and that the material subsequently is tempered once or several times at a temperature of 150–650° C.

Further characteristic features and aspects of the invention and advantages and effects that can be achieved through the invention will be apparent from the appending patent claims and from the following description of performed experiments and calculations.

DESCRIPTION OF PERFORMED EXPERIMENTS

Materials and Performance of Experiments

Figure 1:
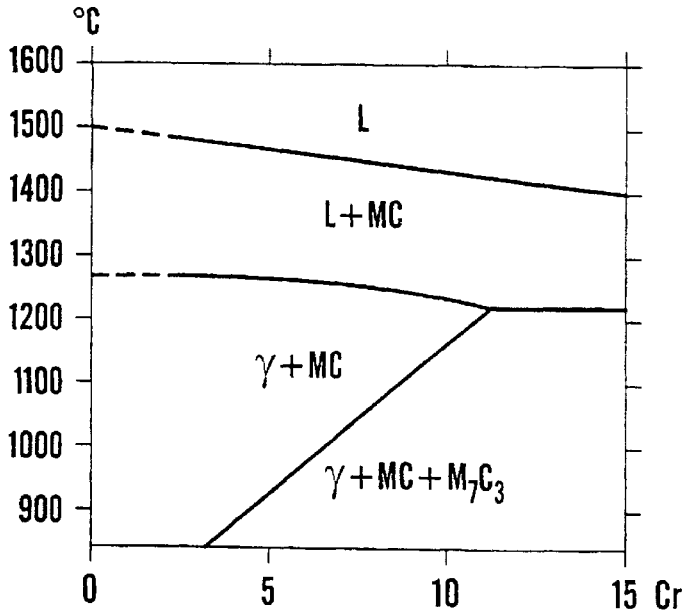
FIG. 1 shows a phase diagram of a steel according to the invention versus the chromium content.
Figure 3:
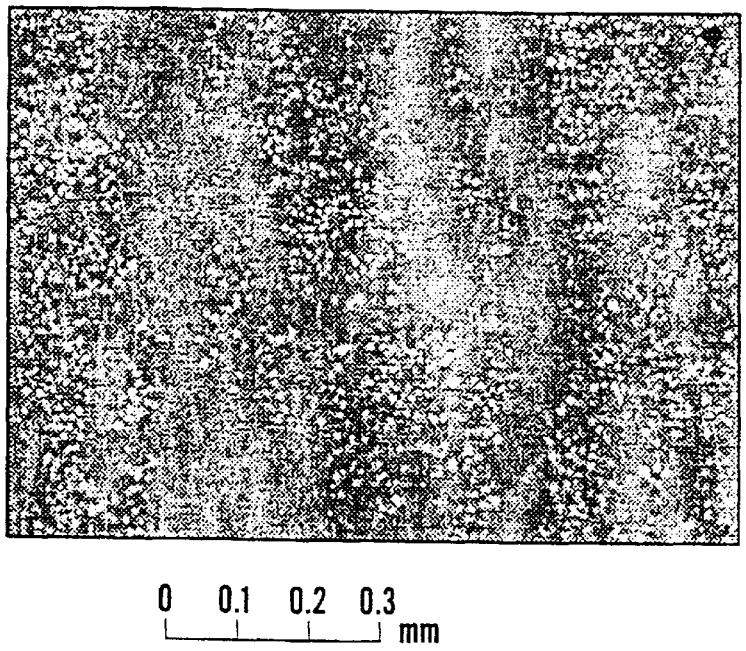
FIG. 3 shows the micro-structure of a steel of the invention in hardened and tempered state (cast and forged)

Nine test alloys were manufactured, steels Nos. 1–9, in the form of 50 kg heats. The compositions are stated in Table 3. In the table also the nominal compositions of some reference materials are indicated, namely AISI D2, steel No. 10, AISI D6, steel No. 11, and steels which are made powder-metallurgically and which are known under their trade names VANADIS® 10 and VANADIS® 4, steels Nos. 12 and 13.

TABLE 4

Chemical composition in weight-% of examined steels

| Steel No. | C | Si | Mn | P | S | Cr | Mo | W | V | Nb | N |
|---|---|---|---|---|---|---|---|---|---|---|---|
| 1 | 0.80 | 0.50 | 0.60 | 0.010 | 0.010 | 4.73 | 0.01 | 0.12 | 3.66 | — | 0.03 |
| 2 | 1.40 | 0.97 | 1.54 | 0.008 | 0.011 | 5.85 | 0.01 | 0.01 | 3.85 | — | 0.04 |
| 3 | 1.86 | 0.96 | 1.47 | 0.010 | 0.012 | 6.01 | 0.01 | 0.01 | 5.80 | — | 0.05 |
| 4 | 2.80 | 1.36 | 0.96 | 0.021 | 0.009 | 4.51 | 0.04 | 0.01 | 11.02 | — | 0.05 |
| 5 | 2.70 | 0.93 | 1.67 | 0.018 | 0.014 | 6.07 | 0.02 | 0.01 | 8.75 | — | 0.06 |
| 6 | 2.50 | 0.91 | 1.63 | 0.018 | 0.013 | 6.06 | 0.02 | 0.01 | 7.8 | — | 0.05 |
| 7 | 3.00 | 0.79 | 0.62 | 0.025 | 0.012 | 6.05 | 2.87 | 0.02 | 8.91 | — | 0.08 |
| 8 | 3.10 | 0.81 | 0.69 | 0.020 | 0.013 | 6.04 | 0.12 | 6.64 | 9.13 | — | 0.06 |
| 9 | 3.20 | 0.79 | 0.65 | 0.021 | 0.012 | 5.90 | 0.06 | 5.90 | 8.94 | 0.96 | 0.06 |
| 10 | 1.5 | 0.3 | 0.3 | | | 12.0 | 1.0 | — | 1.0 | | |
| 11 | 2.1 | 0.3 | 0.8 | | | 12.5 | — | 1.3 | — | | |
| 12 | 2.9 | 1.0 | 0.5 | | | 8.0 | 1.5 | | 9.8 | | |
| 13 | 1.5 | 1.0 | 0.4 | | | 8.0 | 1.5 | | 4.0 | | |

Efforts were made to forge all the ingots to size 60×60 mm according to normal practice for steels of type AISI D2, steel No. 10, whereupon the bars were cooled in vermiculite. Soft annealing was performed according to normal practice for AISI D2.

In the text and in the drawings there are a number of designations and abbreviations which are defined as follows:

HB=Brinell hardness

HV10=hardness according to Vickers 10 kg

HRC=hardness according to Rockwell $t_{8-5}$=cooling velocity expressed as seconds required for cooling from 800° C. to 500° C.

$T_A$=tempering temperature ° C.

h=hour

MC=MC carbides, where M is substantially vanadium $M_7C_3$=$M_7C_3$ carbides, where M is substantially chromium $M_7C_3$ (lamella-eutectic change)=eutectic precipitation of $M_7C_3$ carbides in austenite in which the carbides are essentially lamellar Ms=temperature of initial formation of martensite $A_{c1}$=temperature of initial transformation to austenite $A_{c3}$=temperature of final transformation to austenite.

The following tests were performed.

1. Hardness (HB) after soft annealing.
2. Micro-structure in the cast and in the forged state, hardened and tempered.
3. Hardness (HRC) after austenitising at 1000, 1050 and 1100° C./30 min/air.
4. Hardness (HRC) after tempering at 200, 300, 400, 500, 525, 550, 600 and 650° C./2×2 h.
5. The hardenability at three cooling velocities with $t_{8-5}$=1241, 2482 and 4964 sec.
6. Rest austenite determination after $T_A$=1050° C./30 min/air and $T_A$=1050° C./30 min+500° C./2×2 h.
7. Unnotched impact tests at room temperature. $T_A$=1050° C./30 min+525° C. /2×2 h.
8. Wear tests, $T_A$=1050° C./30 min+525° C./2×2 h.

Results

Hardness in Soft Annealed State

The hardness of the investigated alloys in their soft annealed state is shown in Table 5.

TABLE 5

Hardness of the tested alloys in soft annealed state

| Alloy Steel No. | Hardness (HB) |
|---|---|
| 2 | 237 |
| 3 | 249 |
| 5 | 275 |
| 6 | 277 |
| 7 | 295 |
| 8 | 311 |
| 9 | 319 |
| 11 | 240 |
| 12 | 275 |

Micro-structure

The micro-structure after hardening and tempering in the cast (not all) and forged state were studied. In the two alloys having the lowest content of vanadium, steels Nos. 1 and 2; the carbides had shapes varying from elongated to round and were arranged in rows in regions of segregations. The other alloys had a characteristic micro-structure consisting of an even distribution of essentially round MC carbides, the major portion, with reference to volume, having a size between 5 and 20 μm in tempered martensite. Also a considerable portion of $M_7C_3$ (lamella eutecticum) occurred. The results are apparent from Table 6 and from FIG. 2, which show the micro-structure in the tempered and hardened state (cast and forged) of steel No. 8; $T_A$=1050° C./30 min+525° C./2×2 h, 65.6 HRC.

TABLE 6

Vol.-% carbides separated as MC and $M_7C_3$ (lamella eutecticum)

| Alloy | Measured | | |
|---|---|---|---|
| Steel No. | MC | $M_7C_3$ | Total |
| 2 | 1.6 | 5.4 | 7.0 |
| 3 | 3.7 | 6.0 | 9.7 |

TABLE 6-continued

Vol.-% carbides separated as MC and $M_7C_3$ (lamella eutecticum)

| Alloy | Measured | | |
|---|---|---|---|
| Steel No. | MC | $M_7C_3$ | Total |
| 5 | 10.2 | 5.8 | 16.0 |
| 7 | 13.9 | 6.2 | 20.1 |
| 8 | 9.5 | 12.9 | 22.4 |
| 9 | 14.4 | 13.1 | 27.6 |

Hardness Versus Austenitising and Tempering Temperature

Figure 4:
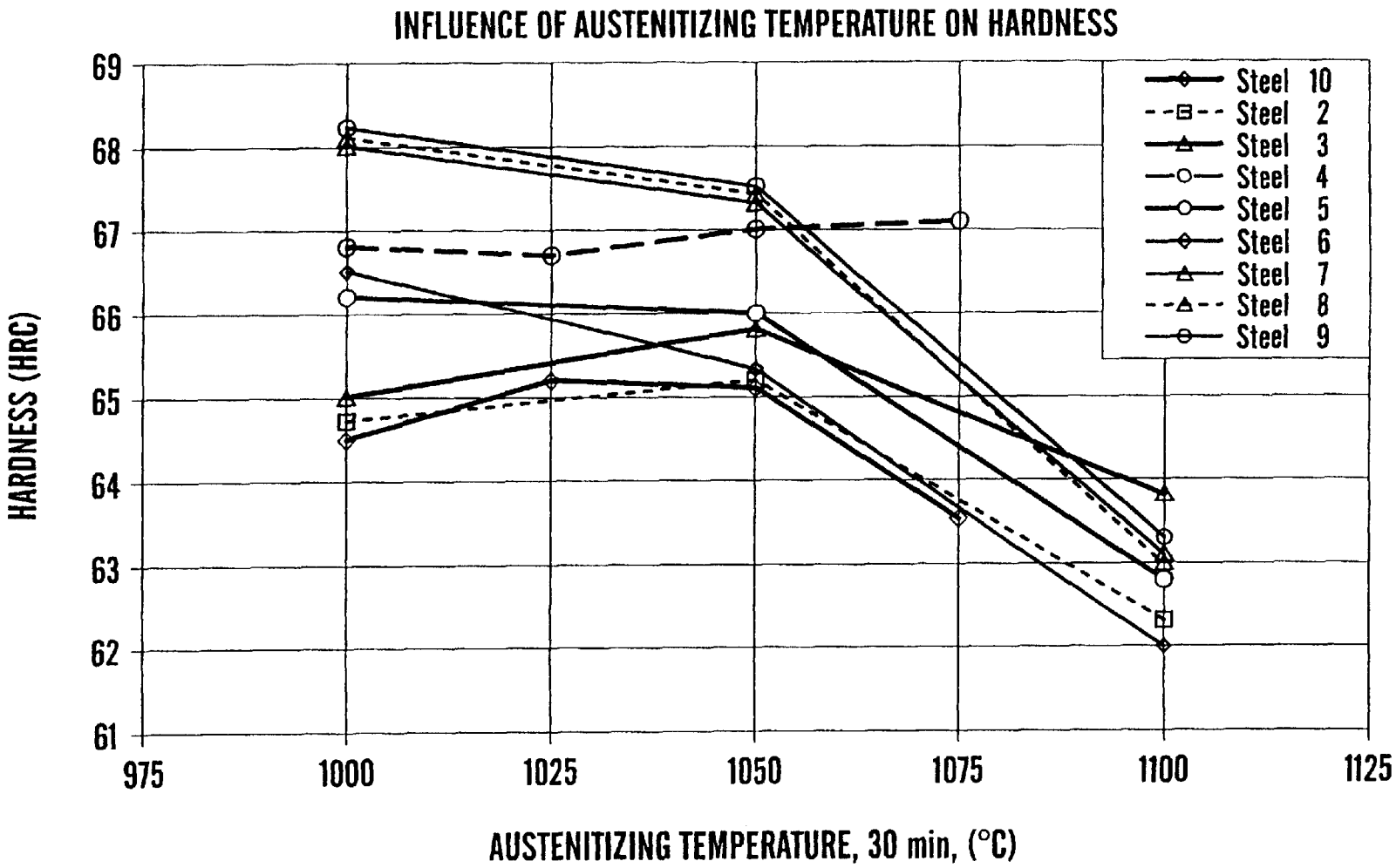
FIG. 4 shows the influence of the austenitising temperature on the hardness of examined steels.
Figure 5:
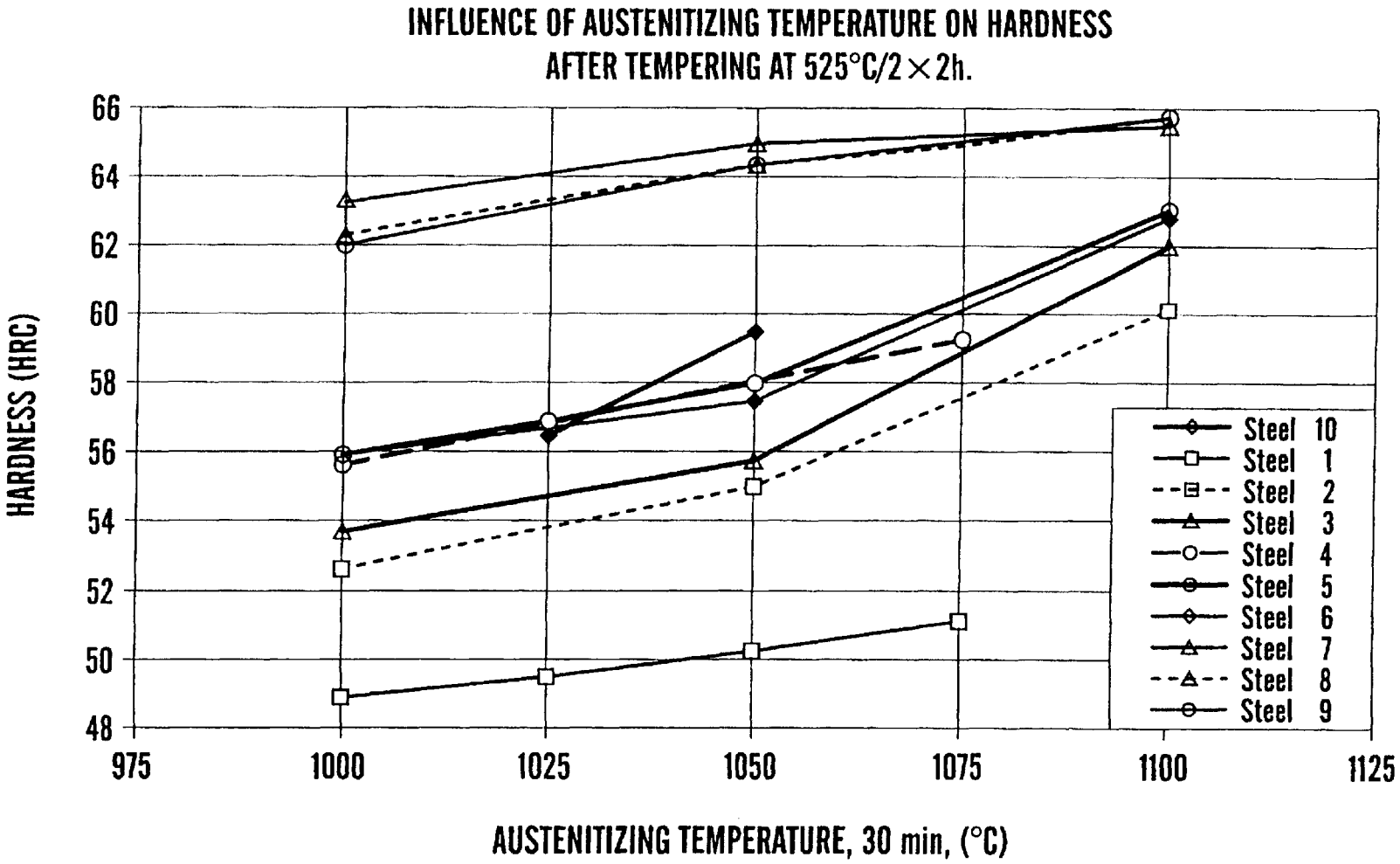
FIG. 5 shows the influence of the austenitising temperature on the hardness of examined steels after tempering 525° C./2×2 h.
Figure 6:
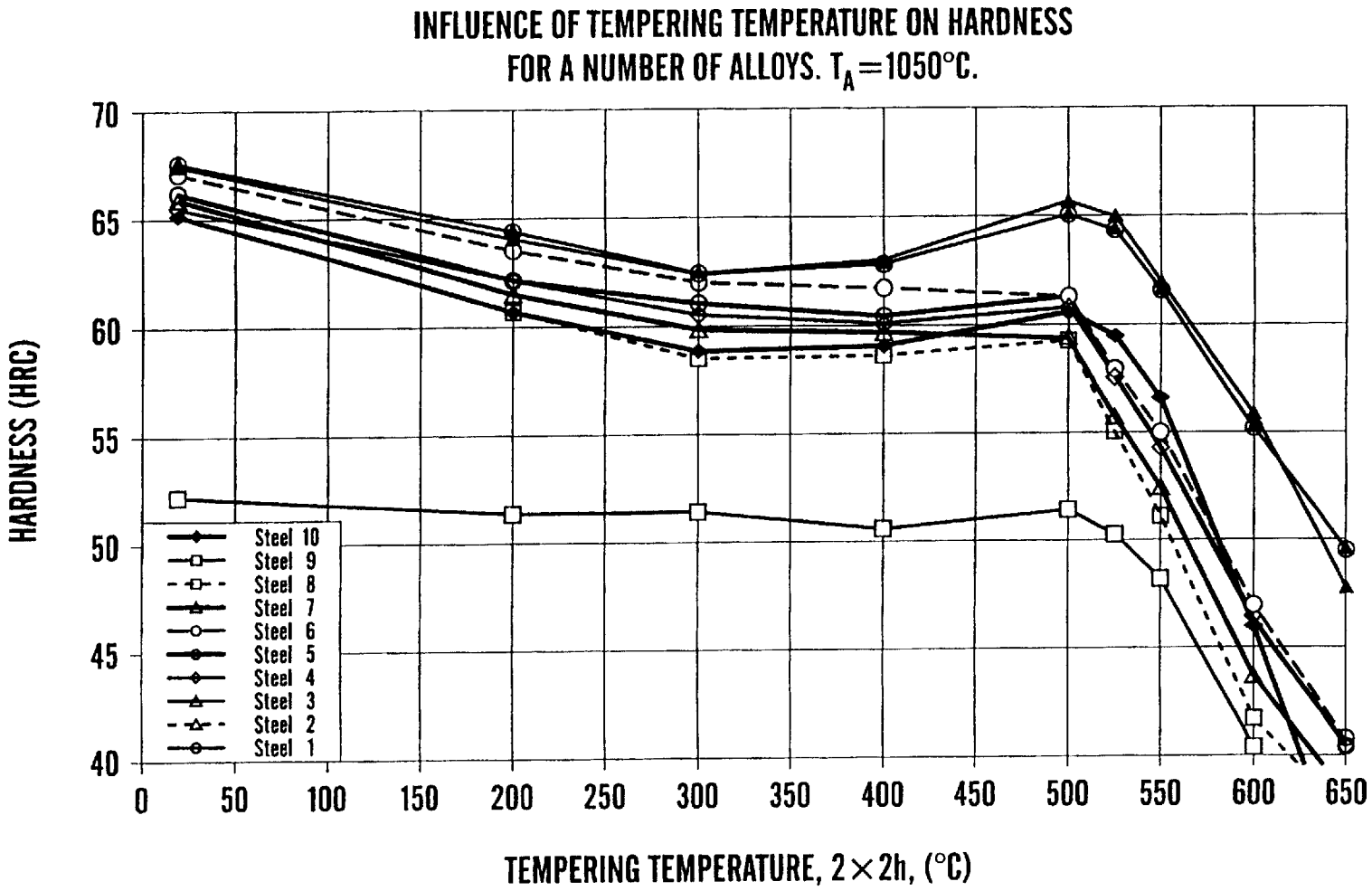
FIG. 6 shows the influence of the tempering temperature on the hardness of examined alloys.

The hardness after austenitising between 1000 and 1100° C./30 min/air cooling to 20° C. is shown in FIG. 4. In FIG. 5 the hardness versus austenitising between 1000 and 1100° C./30 min/air cooling to 20° C. followed by tempering 525° C./2×2 h is visualised. FIG. 6 shows tempering curves after austenitising at 1050° C. for the examined alloys. In all diagrams, steel No. 10 is included as a reference. Those alloys which do not contain molybdenum and/or tungsten have a tempering resistance similar to that of steel No. 10 (AISI D2) while the other alloys have a tempering resistance which is similar to that of the high speed steels. The hardness varies between 60 and 66 HRC after austenitising between 1050 and 1100° C. and tempering at 500–550° C.

Hardenability

Figure 7A:
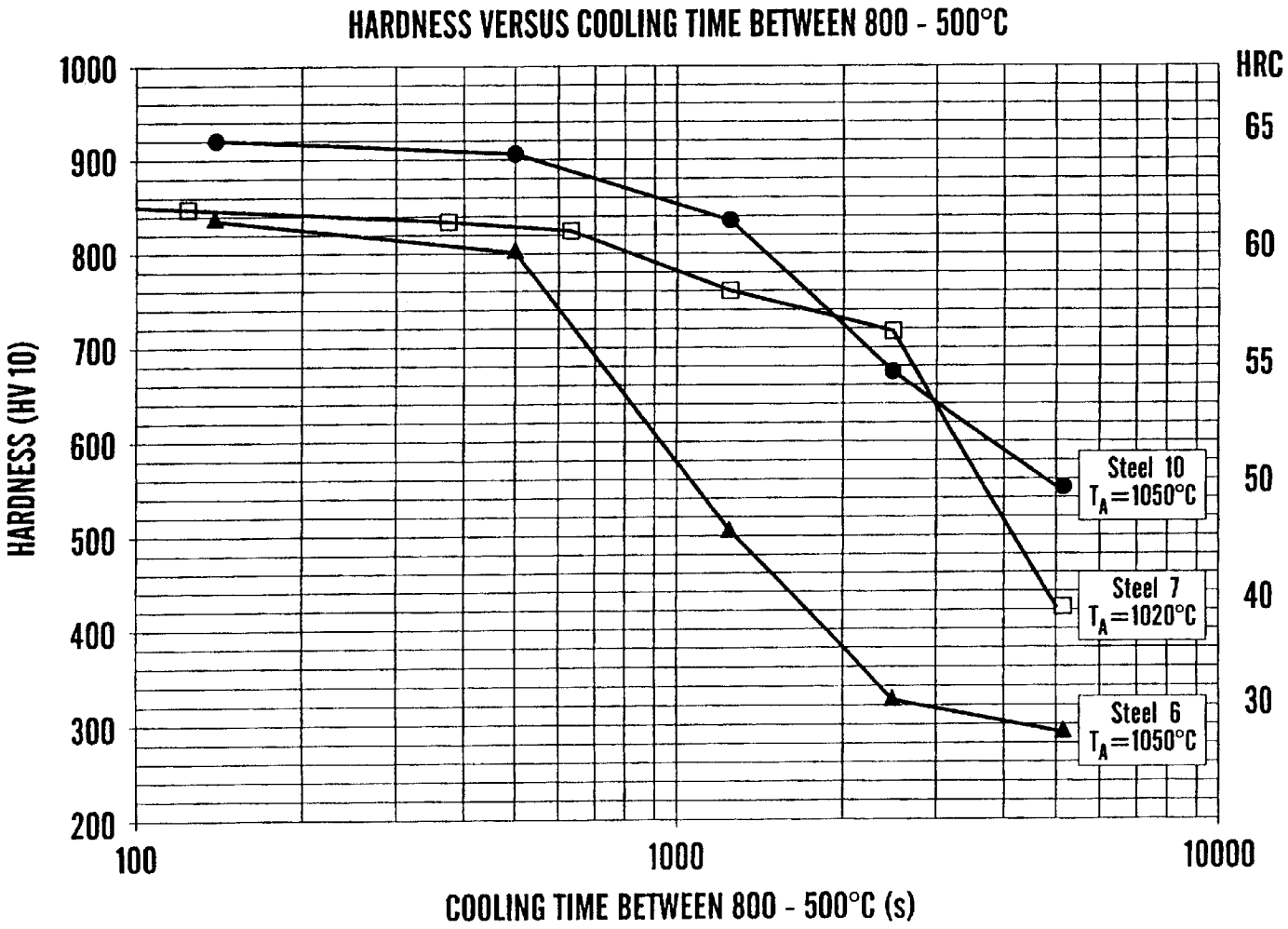
FIG. 7A shows the hardness versus the cooling time between 800 and 500° C. for some examined materials.
Figure 7B:
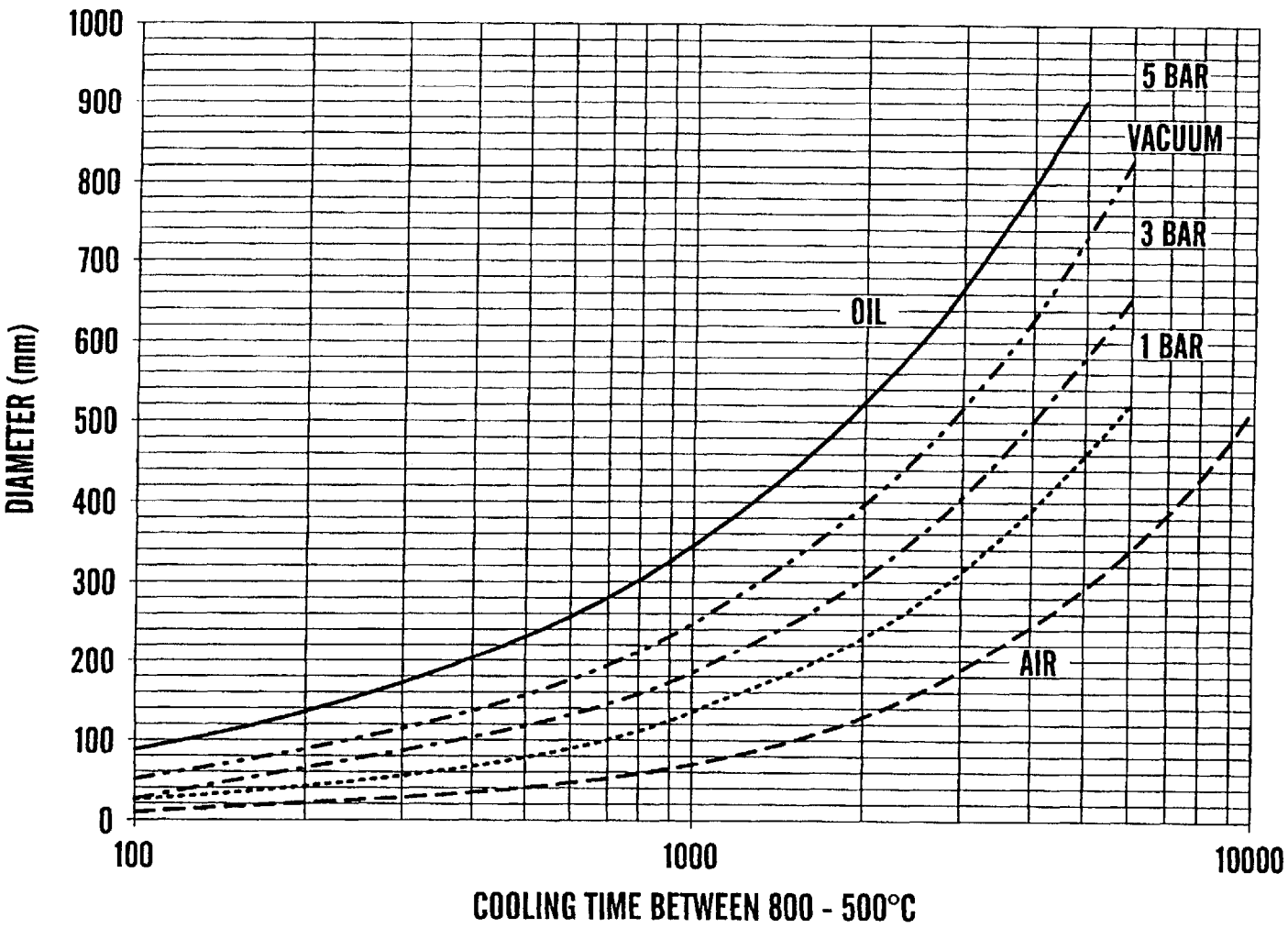
FIG. 7B shows the cooling time for different diameters and cooling agents.

The hardenability of steels Nos. 2, 7 and 10 was compared in dilatometer for a number of different cooling velocities and from 1050° C. austenitising temperature (30 min), FIG. 7A and FIG. 7B. The absence of molybdenum and/or tungsten in steel No. 2 led to the result that the hardenability became significantly lower than for steel No. 10, AISI D2. The addition of about 3% molybdenum in steel No. 7, however, caused the hardenability to be comparable with, or better, than that of steel No. 10.

Ms, $Ac_1$ and $Ac_3$ are shown in Table 7 for some of the examined alloys.

TABLE 7

Transition temperatures

| Alloy Steel No. | Ms (° C.) | $Ac_1$ (° C.) | $Ac_3$ (° C.) |
|---|---|---|---|
| 2 | 180 | 800 | 860 |
| 7 | 150 | 780 | 900 |
| 10 | 180 | 810 | 880 |
| 11 | 220 | 795 | 835 |
| 12 | 245 | 860 | 920 |

Toughness

The impact energy was measured at room temperature for the steels which are given in Table 8. The toughness decreased with increased carbide content and vanadium content but was maintained to a point representing an alloy content corresponding to that of steels Nos. 5 and 7, which contain about 9% V, at the same level as the toughness of steel No. 10, AISI D2. This indicates that steels of the invention in the content range of 6–9% V obtain a better toughness than the ledeburitic steel No. 10, Table 8.

TABLE 8

Impact energy for unnotched specimens at room temperature. Location of test: center, longitudinal direction

| Alloy Steel No. | Hardness (HRC) | Unnotched impact energy (J) |
|---|---|---|
| 2 | 56.5 | 12 |
| 3 | 56.5 | 11 |
| 5 | 58.5 | 8 |
| 6 | 58.5 | 7 |
| 7 | 65.5 | 8 |
| 8 | 64.5 | 7 |
| 9 | 65 | 6 |
| 10 | 59.5 | 8 |

Abrasive Wear Resistance

The abrasive wear resistance was evaluated through wear resistance tests made against Slip Naxos-disc, SGB46HVX, see Table 9. Generally the wear resistance increased with larger and more carbides, higher hardness and by addition of V/Nb for the formation of the harder MC carbides. In the table, low values represent high wear resistance and vice versa.

TABLE 9

Results from wear tests

| Alloy Steel No. | Hardness (HRC) | G number SGB46HVX |
|---|---|---|
| 2 | 56.5 | 3.5 |
| 3 | 56.5 | 1 |
| 5 | 58.5 | 0.5 |
| 7 | 65.5 | 0.9 |
| 11 | 58 | 0.3 |
| 12 | 62 | 2 |
| 13 | 60.0 | 3.8 |

Figure 2:
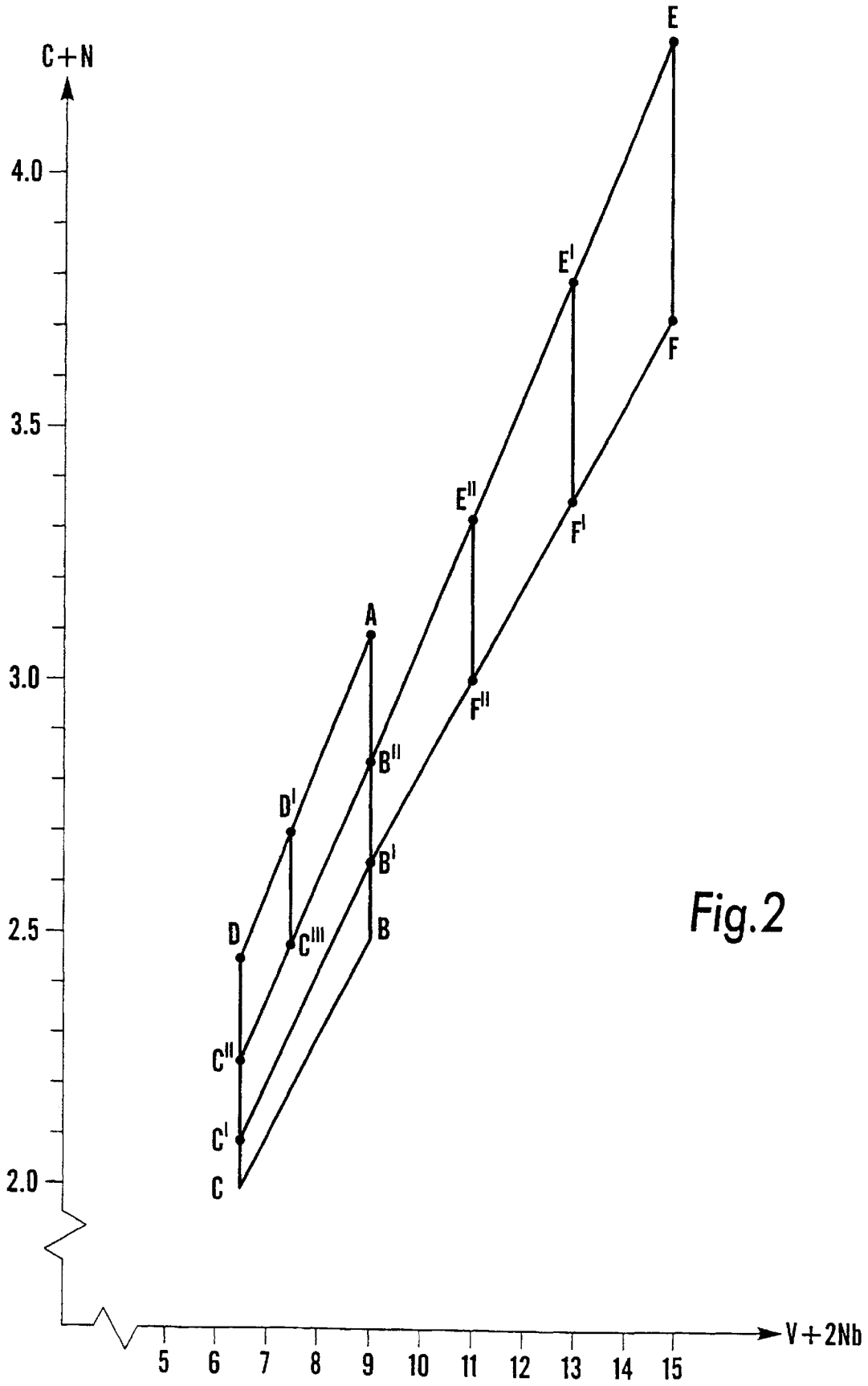
FIG. 2 shows the relations between on one hand vanadium and niobium and on the other hand carbon and nitrogen in the form a co-ordinate system.

We claim:

1. Steel material, which is manufactured in a non-powder metallurgical way, comprising manufacture of ingots or castings from a melt, characterised in that the material consists of an alloy having the following chemical composition in weight-%:

| | |
|---|---|
| Carbon: | 2.0–4.3% |
| Silicon: | 0.1–2.0% |
| Manganese: | 0.1–2.0% |
| Chromium: | 5.6–8.5% |
| Nickel: | max 1.0% |
| Molybdenum: | 1.7–3%, wherein Mo completely or partly can be replaced by double the amount of W |
| Niobium: | max 2.0% |
| Vanadium: | 6.5–15%, wherein V partly can be replaced by the double amount of Nb up to max 2% Nb |
| Nitrogen: | max 0.3% |

wherein the contents of on one hand carbon and nitrogen and on the other hand vanadium and any possibly existing niobium shall be balanced relative to each other, such that the contents of the said elements shall lie within the area of A, B", E, F, B', B, C, D, A in the co-ordinate system in FIG. 2, where V+2 Nb,C+N-co-ordinates for said points are

A: 9,3.1

B": 9,2.85

E: 15,4.3

F: 15,3.75

B': 9,2.65

B: 9,2.5

C: 6.5,2.0

D: 6.5,2.45, balance essentially only iron and impurities and that the material at room temperature, after hardening and tempering, has a hardness between 55 and 66 HRC and a micro-structure consisting of a matrix, which substantially consists of martensite and, in said matrix, 10–40 vol.-% of hard particles of MX type, where M is vanadium and/or niobium, and X is carbon and/or nitrogen, said hardness and structure being obtainable through the non-powder metallurgical method of manufacture and through heating of the material to a temperature between 900° C. and 1150° C., through-heating of the material at said temperature during a period of time of 15 min to 2 h, cooling the material to room temperature and tempering it once or several times at a temperature of 150–650° C.

2. Steel material according to claim 1, characterised in that the contents of on one hand carbon+nitrogen and on the other hand vanadium and any possibly existing niobium are balanced relative to each other, such that the contents of said elements will lie within the area A, B, C, D, A in the co-ordinate system in FIG. 2, where V+2 Nb,C+N-co-ordinates for said points are

A: 9,3.1

B: 9,2.5

C: 6.5,2.0

D: 6.5,2.45 wherein said matrix contains 10–25 vol.-% of hard particles of MX type.

3. Steel material according to claim 2, characterised in that the contents of on one hand carbon+nitrogen and on the other hand vanadium and any possibly existing niobium are balanced relative to each other, such that the contents of said elements will lie within the area A, B', C', D', A in the co-ordinate system in FIG. 2, where V+2 Nb,C+N-co-ordinates for said points are

A: 9,3.1

B': 9,2.65

C': 6.5,2.1

D: 6.5,2.45.

4. Steel material according to claim 2, characterised in that the contents of on one hand carbon+nitrogen and on the other hand vanadium and any possibly existing niobium are balanced relative to each other, such that the contents of said elements will lie within the area A, B", C", D, A in the co-ordinate system in FIG. 2, where V+2 Nb,C+N-co-ordinates for said points are

A: 9,3.1

B": 9,2.85

C": 6.5,2.25

D: 6.5,2.45.

5. Steel material according to claim 2, characterised in that the contents of on one hand carbon+nitrogen and on the other hand vanadium and any possibly existing niobium are balanced relative to each other, such that the contents of said elements will lie within the area A, B", C"', D', A in the coordinate system in FIG. 2, where V+2 Nb,C+N-co-ordinates for said points are

A: 9,3.1

B": 9,2.85

C"': 7.5,2.5

D': 7.5,2.7.

6. Steel material according to claim 2, characterised in that the contents of on one hand carbon+nitrogen and on the other hand vanadium and any possibly existing niobium are balanced relative to each other, such that the contents of said elements will lie within the area A, B', C', C", C"', D', A, in the co-ordinate system in FIG. 2, where V+2 Nb,C+N-co-ordinates for said points are

A: 9,3.1

B': 9,2.65

C': 6.5,2.1

C": 6.5,2.25

C"': 7.5,2.5

D': 7.5,2.7.

7. Steel material according to claim 2, characterised in that the contents of on one hand carbon+nitrogen and on the other hand vanadium and any possibly existing niobium are balanced relative to each other, such that the contents of said elements will lie within the area B", B', C', C", B" in the coordinate system in FIG. 2, where V+2 Nb,C+N-co-ordinates for said points are

B": 9,2.85

B': 9,2.65

C': 6.5,2.1

C": 6.5,2.25.

8. Steel material according to claim 2, characterised in that the contents of on one hand carbon+nitrogen and on the other hand vanadium and any possibly existing niobium are balanced relative to each other, such that the contents of said elements will lie within the area D', C"', C", D, D' in the co-ordinate system in FIG. 2, where V+2 Nb,C+N-co-ordinates for said points are

D': 7.5,2.7

C"': 7.5,2.5

C": 6.5,2.25

D: 6.5,2.45.

9. Steel material according to claim 2, characterised in that the contents of on one hand carbon+nitrogen and on the other hand vanadium and any possibly existing niobium are balanced relative to each other, such that the contents of said elements will lie within the area B", E, F, B', B" in the co-ordinate system in FIG. 2, where V+2 Nb,C+N-co-ordinates for said points are

B": 9,2.85

E: 15,4.3

F: 15,3.75

B': 9,2.65.

10. Steel material according to claim 9, characterised in that the contents of on one hand carbon+nitrogen and on the other hand vanadium and any possibly existing niobium are balanced relative to each other, such that the contents of said elements will lie within the area B", E", F", B', B" in the co-ordinate system in FIG. 2, where V+2 Nb,C+N-co-ordinates for said points are

B": 9,2.85

E": 11,3.35

F": 11,3.05

B': 9,2.65.

11. Steel material according to claim 9, characterised in that the contents of on one hand carbon+nitrogen and on the other hand vanadium and any possibly existing niobium are balanced relative to each other, such that the contents of said elements will lie within the area E", E', F', F", E" in the co-ordinate system in FIG. 2, where V+2 Nb,C+N-co-ordinates for said points are E": 11,3.35

E': 13,3.83

F': 13,3.4

F": 11,3.05.

12. Steel material according to claim 9, characterised in that the contents of on one hand carbon+nitrogen and on the other hand vanadium and any possibly existing niobium are balanced relative to each other, such that the contents of said elements will lie within the area E', E, F, F', E' in the co-ordinate system in FIG. 2, where V+2 Nb,C+N-co-ordinates for said points are

E': 13,3.83

E: 15,4.3

F: 15,4.0

F': 13,3.4.

13. Steel material according to claim 1, characterised in that the steel contains at least 6% chromium.

14. Steel material according to claim 13, characterised in that the steel contains less than 8% chromium.

15. Steel material according to claim 1, characterised in that the steel contains 2.1–2.8% molybdenum.

16. Steel material according to claim 1, characterised in that it contains in weight-%: 2.55 C, 0.5–1.0 Si, 0.2–1.0 Mn, 7.0 Cr, 8.0 V, 2.3 Mo.

17. Steel material according to claim 1, characterised in that it contains in weight-%: 2.7 C, 0.5–1.0 Si, 0.2–1.0 Mn, 7.0 Cr, 8.0 V, 2.3 Mo.

18. Steel material according to claim 1, characterised in that it contains in weight-%: 2.45 C, 0.5–1.0 Si, 0.2–1.0 Mn, 7.0 Cr, 7.0 V, 2.3 Mo.

19. Steel material according to claim 1, characterised in that it contains in weight-%: 3.0 C, 0.5–1.0 Si, 0.2–1.0 Mn, 7.0 Cr, 10 V, 2.3 Mo.

20. Steel material according to claim 1, characterised in that it contains in weight-%: 3.5 C, 0.5–1.0 Si, 0.2–1.0 Mn, 7.0 Cr, 12 V, 2.3 Mo.

21. Steel material according to claim 1, characterised in that it contains in weight-%: 3.9 C, 0.5–1.0 Si, 0.2–1.0 Mn, 7.0 Cr, 14 V, 2.3 Mo.

22. Steel material according to claim 1, characterised in that at least 50 vol-% of said hard particles of MX type have sizes between 3 and 20 $\mu$m.

23. Method of manufacturing a steel material, characterised in that there is first produced a melt of an alloy having a chemical composition according to claim 1, that said melt is cast to ingots or castings, wherein the melt is caused to solidify so slowly that there is precipitated in the melt during the solidification process 10–40 vol-% of hard particles of MX type, where M is vanadium and/or niobium, preferably vanadium, and X is carbon and nitrogen, preferably essentially carbon, at least 50 vol-% of said hard particles having sizes between 3 and 20 $\mu$m.

24. Method according to claim 23 for the manufacture of a steel material, characterised in that there is first produced a melt of an alloy having a chemical composition, that this melt is cast into ingots or castings, wherein the melt is caused to solidify so slowly that there is precipitated during the solidification process 10–25 vol-% of hard particles of MX type.

25. Method according to claim 23 for the manufacture of a steel material, characterised in that there is first produced a melt of an alloy having a chemical composition, that this melt is cast into ingots or castings, wherein the melt is caused to solidify so slowly that there is precipitated in the melt during the solidification process 20–40 vol-% of hard particles of MX type.

26. Method of using a steel material according to claim 1 for the manufacture of cold work tools.

27. Method of using a steel material according to claim 1 for wear parts, i.e. products that are subjected to heavy abrasive wear.

28. Steel material according to claim 13, characterised in that the steel contains at least 6.5% chromium.

29. Steel material according to claim 14, characterised in that the steel contains less than 7.5% chromium.

30. Steel material according to claim 22, characterised in that at least 50 vol-% of said hard particles of MX type have sizes between 5 and 20 $\mu$m.

31. Method of manufacturing a steel material according to claim 23, characterised in that at least 50 vol-% of said hard particles of MX type have sizes between 5 and 20 $\mu$m.

* * * * *